US005682873A

United States Patent [19]

Chambers

[11] Patent Number: 5,682,873

[45] Date of Patent: Nov. 4, 1997

[54] CAMPING STOVE BAKING ATTACHMENT DEVICE

[76] Inventor: Harold Chambers, 109 Glendale Ct., Warner Robins, Ga. 31088

[21] Appl. No.: 672,972

[22] Filed: Jul. 1, 1996

[51] Int. Cl.[6] ..... F24C 1/16

[52] U.S. Cl. ..... 126/275 R; 126/275 E; 126/376; 126/369; 126/261

[58] Field of Search ..... 126/275 R, 275 E, 126/369, 376, 261

[56] References Cited

U.S. PATENT DOCUMENTS

| | | | |
|---|---|---|---|
| 1,456,238 | 5/1923 | Ivancic | 126/275 |
| 2,001,615 | 5/1935 | Karten | 126/275 R |
| 2,072,036 | 2/1937 | Horsman | 126/275 |
| 2,920,615 | 1/1960 | Vacval | 126/275 |

FOREIGN PATENT DOCUMENTS

| | | | |
|---|---|---|---|
| 993517 | 11/1951 | France | 126/275 |
| 369650 | 7/1923 | Germany | 126/275 R |
| 266267 | 2/1927 | United Kingdom | 126/275 |
| 797218 | 6/1958 | United Kingdom | 126/275 R |

*Primary Examiner*—Larry Jones

[57] ABSTRACT

A new Camping Stove Baking Attachment Device for offering an apparatus that can be used in conjunction with a camping stove to provide an oven for baking food. The inventive device includes an attachment housing, a lid, a plurality of lid vents, a food plate, a base plate and an elongated exhaust tube aperture. In use the attachment housing (16) is placed on a camping stove (2) allowing it to come to rest against a bottom side of the base plate (30). Food (4) is then placed on an upper side of the food plate (20). Finally, the lid (12) is placed upon the attachment housing (16). Combustion exhaust flow (24) is routed up through the base plate flame vents 32, the elongated exhaust tube aperture (22), and the lid vents (15). Consequently, the food (4) is baked without ever coming into contact with a flame.

6 Claims, 3 Drawing Sheets

CAMPING STOVE BAKING ATTACHMENT DEVICE

BACKGROUND OF THE INVENTION

1. Field of the Invention

The present invention relates to camping cooking attachments and more particularly pertains to a new Camping Stove Baking Attachment Device for offering an apparatus that can be used in conjunction with a camping stove to provide an oven for baking food.

3. Description of the Prior Art

The use of camping cooking attachments is known in the prior art. More specifically, camping cooking attachments heretofore devised and utilized are known to consist basically of familiar, expected and obvious structural configurations, notwithstanding the myriad of designs encompassed by the crowded prior art which have been developed for the fulfillment of countless objectives and requirements.

Known prior art camping cooking attachments include U.S. Pat. No. 4,320,736; U.S. Pat. No. 5,195,500; U.S. Pat. No. 4,903,683; U.S. Pat. No. 4,751,911; U.S. Pat. No. 4,210,072; and U.S. Pat. No. Des. 341,058.

While these devices fulfill their respective, particular objectives and requirements, the aforementioned patents do not disclose a new Camping Stove Baking Attachment Device. The inventive device includes an attachment housing, a lid, a plurality of lid vents, a food plate, a base plate, and an elongated exhaust tube aperture.

In these respects, the Camping Stove Baking Attachment Device according to the present invention substantially departs from the conventional concepts and designs of the prior art, and in so doing provides an apparatus primarily developed for the purpose of offering an apparatus that can be used in conjunction with a camping stove to provide an oven for baking food.

SUMMARY OF THE INVENTION

In view of the foregoing disadvantages inherent in the known types of camping cooking attachments now present in the prior art, the present invention provides a new Camping Stove Baking Attachment Device construction wherein the same can be utilized for offering an apparatus that can be used in conjunction with a camping stove to provide an oven for baking food.

The general purpose of the present invention, which will be described subsequently in greater detail, is to provide a new Camping Stove Baking Attachment Device apparatus and method which has many of the advantages of the camping cooking attachments mentioned heretofore and many novel features that result in a new Camping Stove Baking Attachment Device which is not anticipated, rendered obvious, suggested, or even implied by any of the prior art camping cooking attachments, either alone or in any combination thereof.

To attain this, the present invention generally comprises an attachment housing, a lid, a plurality of lid vents, a food plate, a base plate, and an elongated exhaust tube aperture.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Camping Stove Baking Attachment Device apparatus and method which has many of the advantages of the camping cooking attachments mentioned heretofore and many novel features that result in a new Camping Stove Baking Attachment Device which is not anticipated, rendered obvious, suggested, or even implied by any of the prior art camping cooking attachments, either alone or in any combination thereof.

It is another object of the present invention to provide a new Camping Stove Baking Attachment Device which may be easily and efficiently manufactured and marketed.

It is a further object of the present invention to provide a new Camping Stove Baking Attachment Device which is of a durable and reliable construction.

An even further object of the present invention is to provide a new Camping Stove Baking Attachment Device which is susceptible of a low cost of manufacture with regard to both materials and labor, and which accordingly is then susceptible of low prices of sale to the consuming public, thereby making such Camping Stove Baking Attachment Device economically available to the buying public.

Still yet another object of the present invention is to provide a new Camping Stove Baking Attachment Device which provides in the apparatuses and methods of the prior art some of the advantages thereof, while simultaneously overcoming some of the disadvantages normally associated therewith.

Still another object of the present invention is to provide a new Camping Stove Baking Attachment Device for offering an apparatus that can be used in conjunction with a camping stove to provide an oven for baking food.

Yet another object of the present invention is to provide a new Camping Stove Baking Attachment Device which includes an attachment housing, a lid, a plurality of lid vents, a food plate, a base plate, and an elongated exhaust tube aperture.

Still yet another object of the present invention is to provide a new Camping Stove Baking Attachment Device that does not grill or flame burn the food.

Even still another object of the present invention is to provide a new Camping Stove Baking Attachment Device that is light weight and portable and is therefore suitable for backpacking and camping trips.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
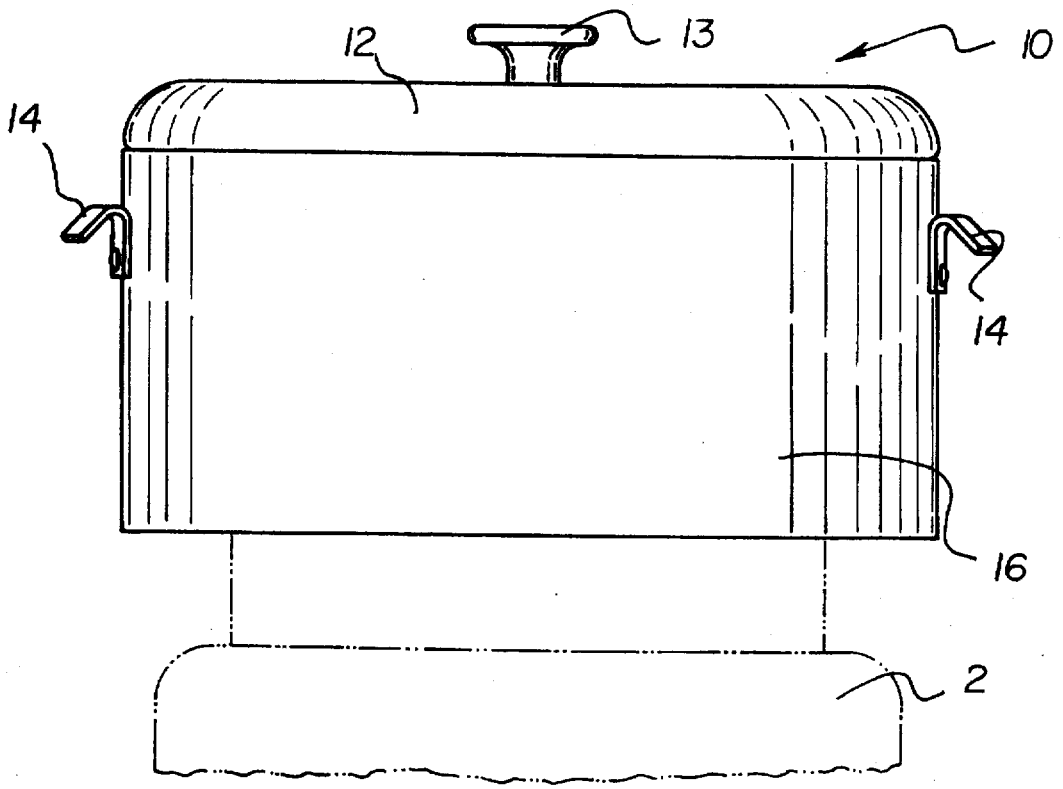
FIG. 1 is a front elevation view of a new Camping Stove Baking Attachment Device according to the present invention.
Figure 2:
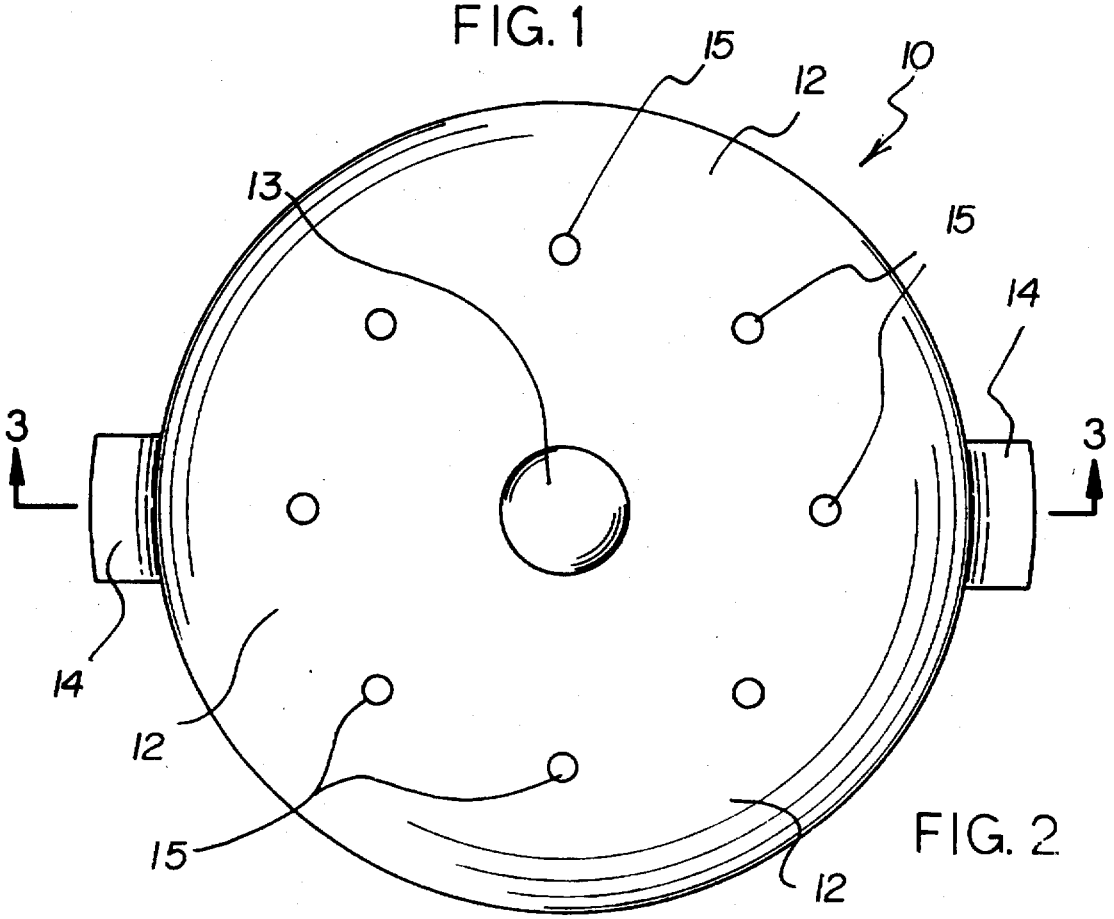
FIG. 2 is a plan view of the present invention.
Figure 3:
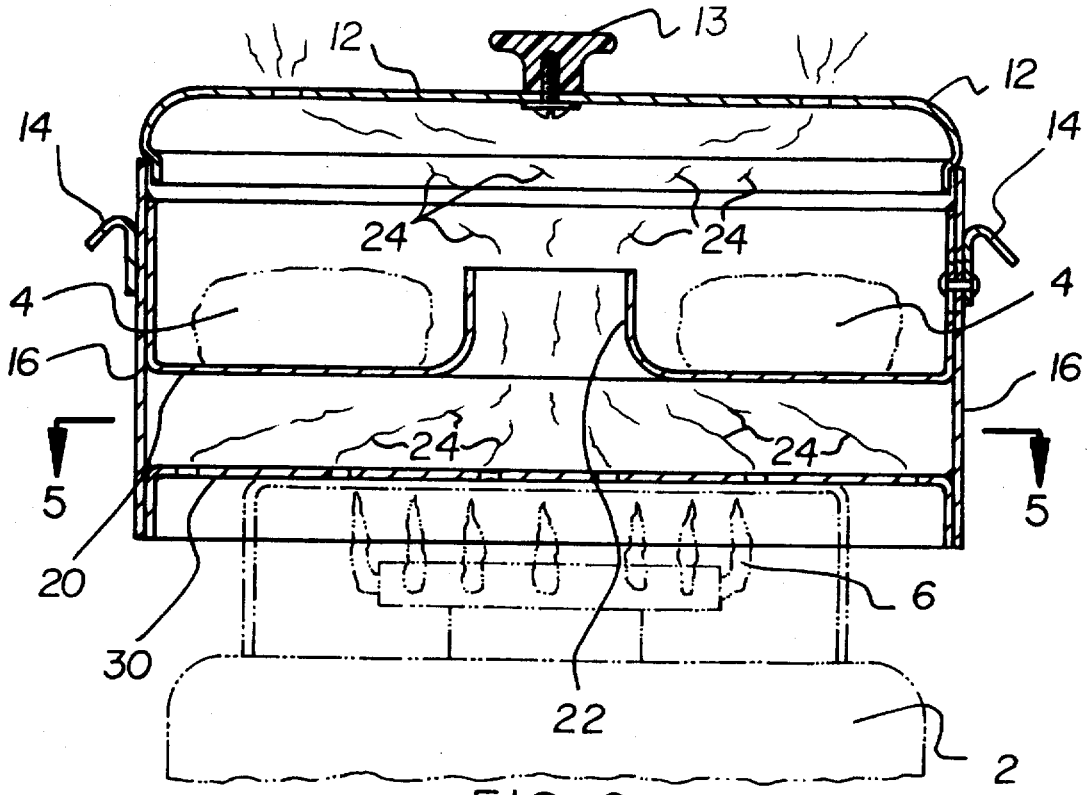
FIG. 3 is a cross sectional view taken along line 3—3 of FIG. 2.
Figure 4:
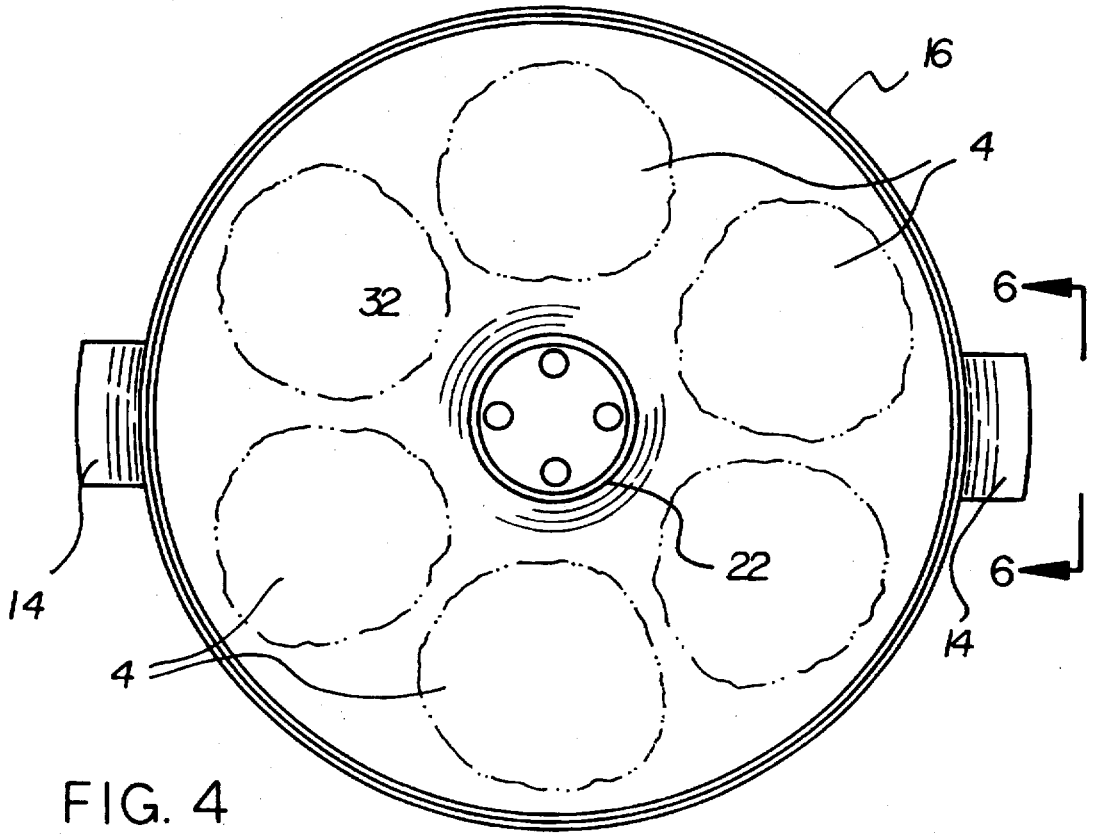
FIG. 4 is a plan view of the invention with a lid removed.
Figure 5:
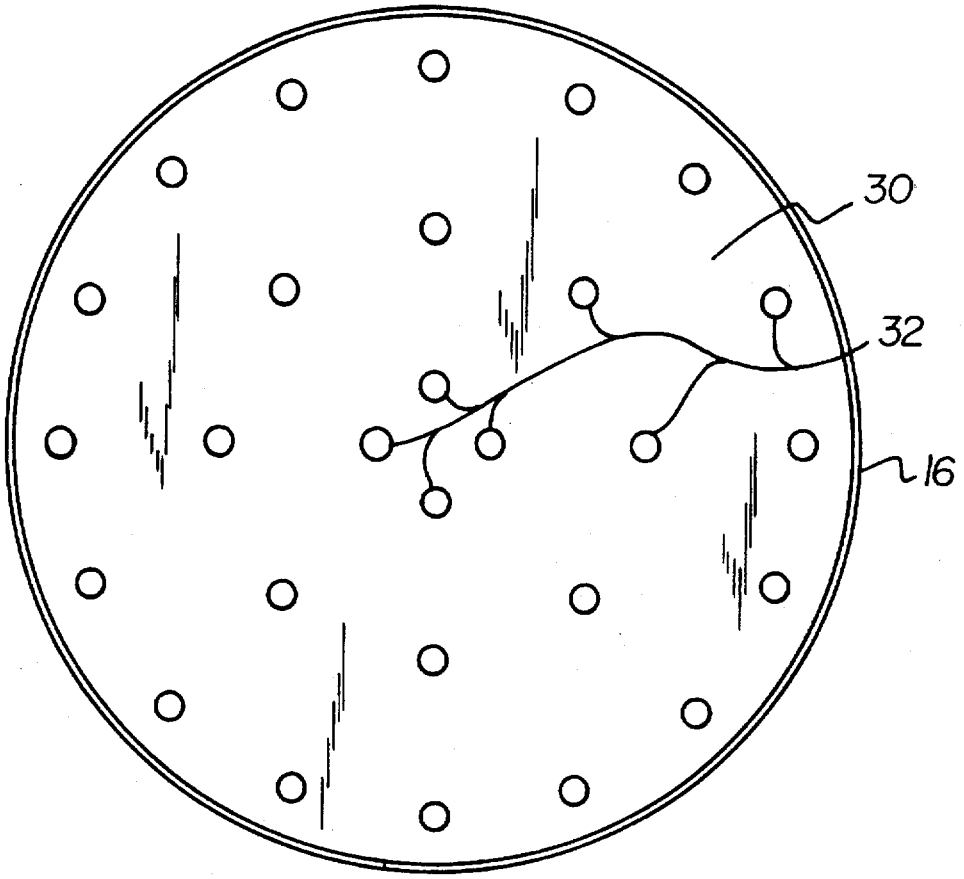
FIG. 5 is a cross sectional view taken along line 5—5 of FIG. 3.
Figure 6:
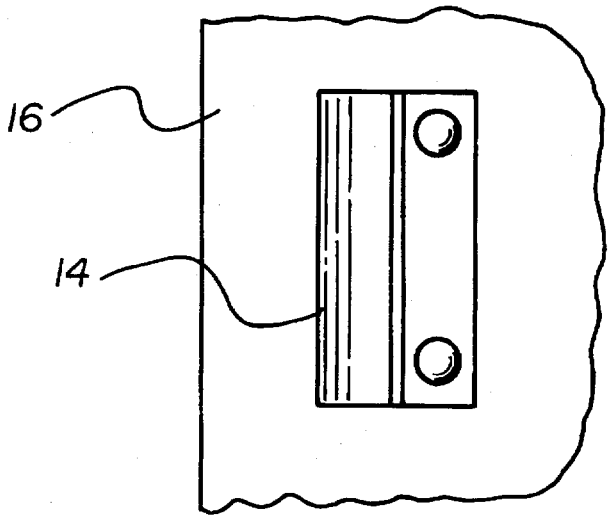
FIG. 6 is an enlarged detail view of a lifting handle of the invention.

With reference now to the drawings, and in particular to FIGS. 1 through 6 thereof, a new Camping Stove Baking Attachment Device embodying the principles and concepts of the present invention and generally designated by the reference numeral 10 will be described.

More specifically, it will be noted that the Camping Stove Baking Attachment Device 10 comprises an attachment housing 16, a lid 12, a plurality of lid vents 15, a food plate 20, a base plate 30, and an elongated exhaust tube aperture 22 where the attachment housing 16 is an elongated cylindrical tubular structure which matingly receives the lid 12, and the lid 12 includes the plurality of lid vents 15 and the attachment housing 16 further includes the food plate 20, the base plate 30, and the elongated exhaust tube aperture 22.

As best illustrated in FIGS. 1 through 6, it can be shown that the attachment housing 16 is further defined as being similar in shape as previously known charcoal grills and kettles. However, the attachment housing 16 is uniquely and specifically design to fit over an existing and previously known camping stove 2. In general, while currently known charcoal grills allow the food 4 to come in contact with a flame, the design of the attachment housing 16 does not allow this to occur.

The attachment housing 16 further includes side handles 14 fixedly fastened to an outer circumference of the attachment housing 16. Additionally, the food plate 20 and the base plate 30 are further defined as being fixedly integral with the attachment housing 16 the base plate 30 further includes a plurality of base plate flame vents 32 which are defined as circular apertures disposed circumferentially in a spaced apart evenly distributed arrangement and allow combustion exhaust flow 24 to flow freely through the base plate 30.

The food plate 20 is defined as an elongated cylindrical element having a circular outer shape that is matingly received by an inner diameter of the attachment housing 16 and the elongated exhaust tube aperture 22 is intergrally in concentric relationship with the circular outer shape of the food plate 20 and where a side of the food plate 20, that is adjacent to the base plate 30, is rounded at both the circular outer shape and the elongated exhaust tube aperture 22 and resultantly allows the combustion exhaust flow 24 to flow freely through an inner opening defined by the elongated exhaust tube aperture 22.

The lid 12 with the lid vents 15, when the lid 12 is installed on the attachment housing 16, allows the combustion exhaust flow 24 to flow freely through the lid vents 15. The lid 12 further includes a lid handle 13 which is fixedly fastened to the lid 12.

In use, the attachment housing 16 is placed on a camping stove 2 allowing it to come to rest against a bottom side of the base plate 30. Food 4 is then placed on an upper side of the food plate 20. Finally, the lid 12 is placed upon the attachment housing 16. Combustion exhaust flow 24 is routed up through the base plate flame vents 32, the elongated exhaust tube aperture 22, and the lid vents 15. Consequently, the food 4 is baked without ever coming into contact with a flame.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A camping stove baking system for placing on top of a camping stove, comprising:

a housing comprising:

a base plate for resting on the top surface of a camping stove and having a substantially circular outer perimeter;

a cylindrical wall mounted to and extending upwardly from the outer perimeter of said base plate, said cylindrical wall having an upper rim;

a heat-conducting food support plate spaced above said base plate and mounted to said cylindrical wall, said food support plate having an upper surface for supporting food thereon and a lower surface; and a removable lid for removably resting on the upper rim of said cylindrical wall in a position spaced above said food support plate;

wherein said base plate has a plurality of flame vent apertures therein for permitting the heated combustion exhaust flow produced by a camping stove upon which said housing rests to pass through said base plate to directly contact and circulate below substantially the entire lower surface of said heat-conductive food support plate to thereby permit heat transfer to substantially the entire lower surface of said food support plate;

wherein said food support plate has a centrally-located aperture and an elongated cylindrical tubular structure mounted to said support plate in alignment with said centrally-located aperture to form a central passage through which a rising heated combustion exhaust flow entering said housing must pass; and wherein said removable lid has a plurality of lid vents spaced radially outward from the center thereof to force said heated combustion exhaust flow to move outwardly from said central passage and over food supported on said food support plate in order to exit said housing;

whereby the openings in said base plate, said food support plate and said removable lid permit the heated combustion exhaust flow from a camping stove to move in an upward direction through said housing.

2. The camping stove baking system of claim 1 wherein said cylindrical wall extends downwardly from the outer perimeter of said base plate to form a partial hood for receiving an upper portion of a camping stove upon which said base plate is rested to guide the heated combustion exhaust flow into the housing through said the flame vent apertures of said base plate.

3. The camping stove baking system of claim 1 additionally comprising a camping stove having a substantially horizontal top surface adapted to permit combustion exhaust flow to exit said stove, and wherein said base plate of said housing rests upon said top surface such that combuction exhaust flow exits said top surface and directly enters the flame vent apertures of said base plate.

4. The camping stove baking system of claim 1 wherein at least two of said flame vent apertures in said base plate are located adjacent the outer perimeter of said base plate to permit the heated combustion exhaust flow to rise up and contact the outer portions of said food support plate adjacent to said cylindrical wall before flowing through the central passage of said food support plate.

5. The camping stove baking system of claim 1 wherein the lid vents are positioned at a location between the outer perimeter of said removable lid and the midpoint between the center of said lid and the outer perimeter.

6. The camping stove baking system of claim 1 wherein said base plate and said food support plate are in a substantially parallel relationship such that the heated exhaust combustion flow from a camping stove is not restricted near the outer portion of said food support plate adjacent to said cylindrical wall.

* * * * *